US005972285A

United States Patent [19]

Knott

[11] Patent Number: 5,972,285

[45] Date of Patent: Oct. 26, 1999

[54] FOAMABLE METAL ARTICLES

[75] Inventor: Wilfried Knott, Essen, Germany

[73] Assignee: Th. Goldschmidt AG, Essen, Germany

[21] Appl. No.: 09/094,270

[22] Filed: Jun. 9, 1998

[30] Foreign Application Priority Data

Jun. 10, 1997 [DE] Germany ..... 197 24 326

[51] Int. Cl.[6] ..... B22F 3/10

[52] U.S. Cl. ..... 419/2

[58] Field of Search ..... 75/20; 419/2

[56] References Cited

U.S. PATENT DOCUMENTS

| | | | |
|---|---|---|---|
| 2,895,819 | 7/1959 | Fiedler | 75/20 |
| 2,983,597 | 5/1961 | Elliott | 75/20 |
| 3,087,807 | 4/1963 | Allen et al. | 75/20 |
| 3,297,431 | 1/1967 | Ridgeway, Jr. | 75/20 |
| 3,300,296 | 1/1967 | Hardy et al. | 75/20 |
| 3,719,223 | 3/1973 | Jarema et al. | 164/79 |
| 3,790,365 | 2/1974 | Niebylski et al | 75/20 |
| 3,826,303 | 7/1974 | Jarema et al. . | |

FOREIGN PATENT DOCUMENTS

| | | |
|---|---|---|
| 0 460 392 B1 | 4/1991 | European Pat. Off. . |
| 41 24 591 C1 | 2/1993 | Germany . |
| 4426 627 A1 | 2/1995 | Germany . |

*Primary Examiner*—Daniel J. Jenkins
*Attorney, Agent, or Firm*—Scully, Scott, Murphy & Presser

[57] ABSTRACT

The invention relates to a process for producing foamable material articles, to the compacted semifinished product obtainable in this way, to the use of the semifinished product for foaming a closed-cell metal article, and to the closed-cell metal articles obtained in this way. The mixtures of the foamable metal articles are produced from at least one metal powder and one gas-producing blowing agent and compacted to a semifinished product, wherein a gas-producing blowing agent comprising magnesium hydride is employed.

19 Claims, 2 Drawing Sheets

Aluminum foam produced with 0.5 m % magnesium hydride
750°C/23 minutes

Aluminum foam produced with 0.5 m % magnesium hydride
750°C/23 minutes

Aluminum foam produced with 0.5 m % titanium hydride
750°C/23 minutes

FOAMABLE METAL ARTICLES

FIELD OF THE INVENTION

The invention relates to a process for producing foamable metal articles, to the compacted semifinished product obtainable in this way, to the use of the semifinished product for foaming a closed-cell metal article, and to the closed-cell foamed metal articles obtained in this way.

BACKGROUND OF THE INVENTION

U.S. Pat. No. 3,087,807 discloses a process with which it is possible to produce a porous metal article of any geometric shape. This entails a mixture of a metal powder and a blowing agent being, in the first step, compacted cold under a pressure of at least 80 MPa. The mixture is subsequently extruded in order to be at least 87.5% compacted. This high degree of compaction is regarded as necessary to destroy the oxide coating on the particles by the mutual friction thereof during the compaction process and to bond the metal particles together. The extruded rod produced in this way can be foamed to a porous metal article by heating to at least the melting point of the metal. The foaming can take place in various molds so that the finished porous metal article has the required shape. The disadvantages of this process are that, because of its two-stage compaction operation and the very high degree of compaction required, it is elaborate and restricted to semifinished products which can be produced by extrusion. The only blowing agents which can be used in the process disclosed herein are those with a decomposition temperature above the compacting temperature, because otherwise the gas would escape during the extrusion operation. The extrusion operation in the process described herein is regarded as necessary because the bonding of the metal particles is produced by the high temperatures occurring during the extrusion operation and by the mutual friction of the particles, i.e. by fusion of the particles together.

EP-B-0 460 392 describes a process for producing foamable metal articles with predominantly closed porosity, where the resulting pores are intended to be uniformly distributed in the entire metal article and to have a uniform size, wherein a mixture of at least one metal powder and at least one gas-producing blowing agent powder is produced and compacted to a semifinished product. The process described herein is characterized in that the hot compaction takes place at a temperature above the decomposition temperature of the blowing agent, with the bonding of the metal powder particles taking place mainly through diffusion, and under a pressure which is high enough to prevent decomposition of the blowing agent in such a way that the metal particles are firmly bonded to one another and represent a gas-tight seal for the gas particles of the blowing agent.

DE-C-41 24 591 describes a process for producing foamable metal articles by rolling a powder mixture, wherein the powder mixture consists of at least one powder containing a blowing agent and one metal powder, wherein the powder mixture is packed into a metal hollow section and rolled. The cold press article obtainable according to this publication can not only be heated before the rolling operation but also be reheated after the individual rolling stages. In this case too, the cold press article is heated to a temperature above the decomposition temperature of the blowing agent.

DE-A-44 26 627 relates to a metallic composite material and to a process for its production. The metallic composite material having a core of one or more porous metallic materials and at least one outer layer of solid material has metallic linkages between the core and the outer layer/outer layers.

BRIEF SUMMARY OF THE INVENTION

The object of the present invention comprises, on the one hand, an improved process for producing foamable metal articles and, on the other hand, an improvement of the industrial properties of the semifinished products and of the closed-cell foamed metal articles by comparison with the prior art.

One aspect of the present invention is a process for producing foamable metal articles, comprising producing a mixture of at least one metal powder and one gas-producing blowing agent and compacting the mixture to a semifinished product, wherein the gas-producing blowing agent comprises magnesium hydride.

A second aspect of the present invention is the process of producing a foamed metal article, comprising subjecting the aforesaid compacted mixture to conditions, e.g. elevated temperature, and/or elevated or reduced pressure, effective to foam said mixture.

A third aspect of the present invention is foamed metal articles produced by the said process.

DETAILED DESCRIPTION OF THE INVENTION

The chemical compound "magnesium hydride" has long been known in the art. However, to date, other gas-producing blowing agents have been used for producing foamable metal articles, for example titanium hydride, carbonates, hydrates or easily volatilizing substances. However, magnesium hydride is now no longer just a laboratory product but can also be obtained commercially on a relatively large scale. One aspect of the present invention is thus the novel use of magnesium hydride for producing foamable metal articles. If, for example, metal powder after thorough mixing is charged with a small amount of blowing agent comprising magnesium hydride, and the mixture obtained in this way is compacted, it is possible to obtain compressed articles useful for producing foamed metal articles. The foamed metal articles obtainable in this way have a very homogeneous pore density distribution extending into the surface regions of the shaped article, which represents a considerable advance by comparison with foamed metal articles obtained using gas-producing blowing agents known in the prior art.

The metallic foamed articles produced with the aid of blowing agent comprising magnesium hydride, especially magnesium hydride produced autocatalytically, have a morphology differing from that of foams obtained, for example, using titanium hydride as gas-producing blowing agent.

Figure 1:
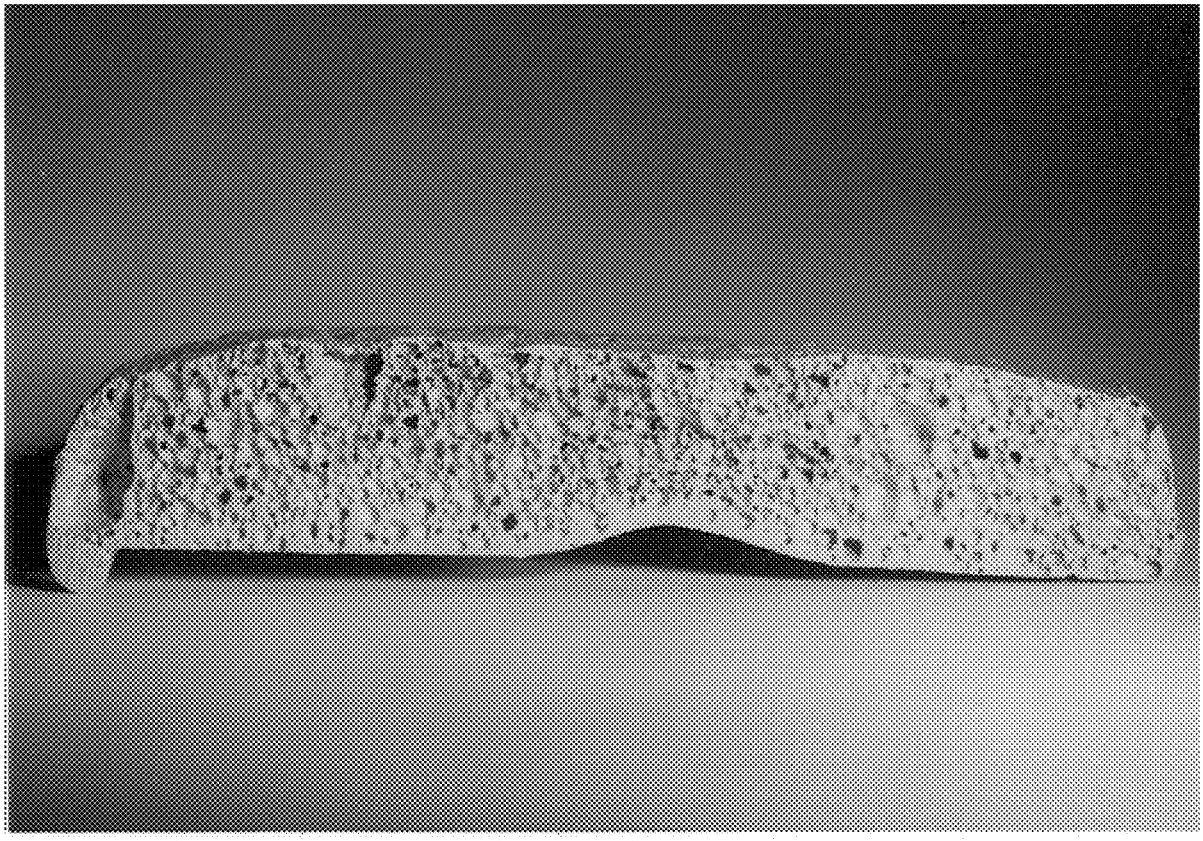
FIGS. 1 and 2 are photographs of cross-sections of foamed metal articles.
Figure 2:
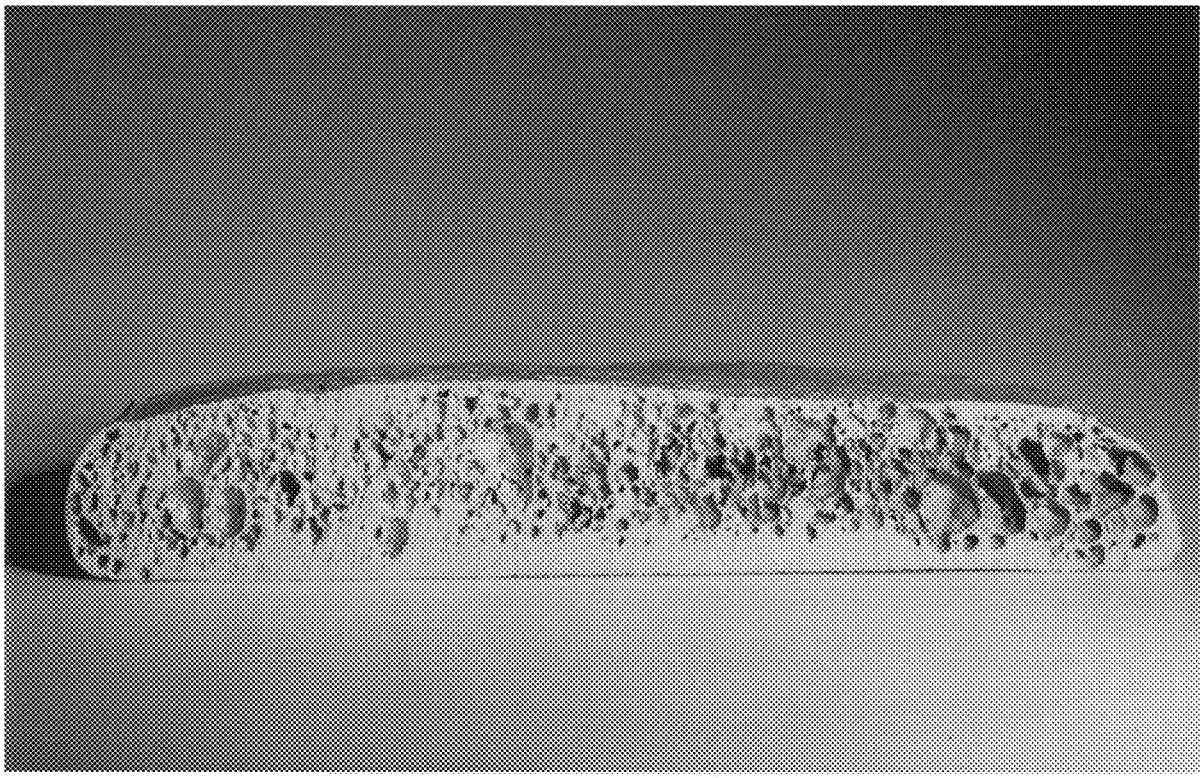

FIGS. 1 and 2 compare an aluminum foam produced according to the invention using 0.5 mol % of magnesium hydride as gas-producing blowing agent (FIG. 1), and a corresponding aluminum foam with which 0.5 mol % of titanium hydride was used as gas-producing blowing agent (FIG. 2). The compaction conditions and foaming conditions were identical in the two cases.

The prior art foam using titanium hydride which has been cut open in FIG. 2 shows extensive compaction of the "base zone" lying at the bottom. The cells distributed in the foamed structure are very irregular. The cells are mainly coarse, and some have risen. This leads to a somewhat fissured surface of the piece of metal when large gas bubbles of this type have "blown off" on the surface of the metal article.

In contrast thereto, the piece of aluminum foam using magnesium hydride according to the present invention in FIG. 1 shows distinctly more uniform foaming. The compaction of the lower side is only about 3 mm thick, whereas up to 1 cm of unfoamed material is to be found on the lower side of the prior art aluminum foam. Moreover the number of cells per unit volume in the novel metal foam is distinctly larger, specifically with preference for the presence of small cells. Although a certain irregularity of the cells is to be found in this foam too, this is distinctly less pronounced than in the prior art foam. The surface of the foam according to the present invention has more openings than that of the prior art foam. The openings are, however, distinctly finer and distinctly more uniform. In analogy to a plastic foam, it is possible to speak, for the purpose of the present invention, of small uniform cells.

Examination of the structures of the cells within the foam in the comparison of the two pieces of meal shown in FIGS. 1 and 2 reveals a peculiarity of the prior art metal foam in FIG. 2. The openings in the "windows" of the gas bubbles frequently appear to be fissured, whereas virtually no such sites are evident in the novel foam in FIG. 1. This indicates that, at the time when the volume of the metal changed, the viscosity of the material foamed according to the prior art is less than that of the material foamed according to the invention. A possible reason for this is, without being committed thereto, that titanium increases the viscosity of the metal surrounding—in this case aluminum—whereas magnesium as constituent of the gas-producing blowing agent has a contrary effect.

Examination of the side regions of the sections of the flat metal specimens shows that the sample foamed according to the prior art has a distinctly different structure of the vertical surfaces than the aluminum foamed article obtainable with the aid of the present invention. Whereas the articles foamed according to the prior art evidently have a relatively original structure with few larger pits (that is to say obviously less volume expansion in the horizontal direction) and, in some cases, the gas being blown off to the side, the novel aluminum foam shows an uneven, but regularly uneven, structure as would be expected with a soap foam of reduced size. This circumstance is to be interpreted to mean that distinctly less gas is lost through faults/fissures on the side of the article, and the metal is able more easily to approach foam morphology at the gas evolution temperature. In the case of the novel foamed metals, it appears to be easier to bring about a uniform volume change both in the horizontal and in the vertical direction than with prior art metal foams.

It is possible in principle to foam all fusible metals or metal alloys as specified in the present invention. The metal powder particularly preferably employed for the purpose of the present invention is aluminum and its alloys. Accordingly, it is particularly preferred for the metal powder to consist essentially of aluminum, where appropriate with conventional alloying constituents such as, for example, magnesium, copper and/or silicon.

A wide variety of processes is available to the skilled worker for compacting the metal powder comprising gas-producing blowing agent. Cold pressing, cold isostatic pressing, rolling and types of extrusion are particularly preferred for the purpose of the present invention. The compacting is particularly preferably carried out for the purpose of the present invention below the decomposition temperature of the gas-producing blowing agent comprising magnesium hydride, preferably at room temperature. Whereas a compaction has usually in the prior art been carried out at high temperature, in particular above the decomposition temperature of the gas-producing blowing agent, it has been found with the novel use of gas-producing blowing agents comprising magnesium hydride that compaction is also possible at low temperatures.

The intention of the compaction is for the mixture of metal powder and gas-producing blowing agent comprising magnesium hydride to be compacted to a density which is as high as possible. It is particularly preferred for the purpose of the present invention to carry out the compaction in such a way that the density is at least 90%, in particular at least 95%, of the theoretical density of the metal in the metal powder. This can be achieved by high compressive forces. Thus, it has been possible to produce a cylinder with a density of more than 90% of the theoretical density of aluminum from atomized nodular aluminum (AlMgSi 6061) by charging with 0.5% magnesium hydride as blowing agent and by cold isostatic pressing with an admission pressure of 450 bar, equivalent to a compressive force of about 10 t.

The amount of gas-producing blowing agent comprising magnesium hydride to be employed according to the invention is normally very small. Thus, proportions of blowing agent of the order of a few tenths of a percent by weight are normally sufficient, because the compacted semifinished product is completely compacted, and blowing gas cannot escape. Amounts of blowing agent of from 0.1 to 2% by weight, in particular 0.2 to 1% by weight, based on the metal powder, have proven particularly beneficial.

The gas-producing blowing agent comprising magnesium hydride which is particularly preferably employed for the purpose of the present invention is magnesium hydride itself, which is commercially available. However, together with magnesium hydride, it is also possible to employ metal hydrides known per se, for example titanium hydride, carbonates, for example calcium carbonate, potassium carbonate, sodium carbonate, sodium bicarbonate, hydrates, for example aluminum sulfate hydrate, alum, aluminum hydroxide or readily vaporizing substances, for example mercury compounds or powdered organic substances.

Another embodiment of the present invention comprises the semifinished products obtained by the compaction, wherein the metal particles are relatively firmly bonded together and form an essentially gas-tight seal for the gas particles of the blowing agent. These semi-finished products can, where appropriate, be compacted by processes known per se in order to permit them to be foamed to a closed-cell metal article by processes known per se under appropriate conditions of pressure and temperature. Thus, the foaming of the semifinished product can take place unconfined if no final shape is specified. Alternatively, however, the foaming can also take place in a partly or completely closed mold, in which case the finished porous metal article assumes the specified shape of the mold. The conditions for foaming the semifinished products are known to the skilled worker from the prior art mentioned in the introduction. Thus, another embodiment of the present invention consists of the use of the above-defined semifinished products for foaming a closed-cell metal article under the action of elevated or reduced pressure and/or elevated temperature. The novel embodiment consists in particular of the use of the semifinished product for foam-filling cavities in molds. Another embodiment of the present invention in addition relates to the closed-cell foamed metal articles obtainable with the aid of the abovementioned process.

EXAMPLE

An atomized, nodular material with the name AlMgSi (6061) and the following composition: Mg 0.96% (without addition of blowing agent) Cu 0.18% Si 0.5% Al remainder, was used. Charged with 0.5% magnesium hydride (produced autocatalytically as disclosed in EP-B-0 490 156, the disclosure of which is hereby incorporated herein by reference) as gas-producing blowing agent, cylindrical compacts were produced therefrom by cold isostatic pressing. The cylinders had a diameter of 52 mm and heights of 24 and 32 mm. The compressive force was 9556 kp for the compression. A density determination verified that the density was about 96% of the theoretical density of aluminum. These semifinished products were then baked in a furnace kept at 750° C. for 23 min. The cross-sectional surface of the resulting aluminum foam is depicted in FIG. 1.

COMPARATIVE EXAMPLE

In analogy to the abovementioned example, a corresponding semifinished product was produced using 0.5% by weight $TiH_{1.98}$ and was baked under the same conditions. The cross-section of the aluminum foam obtained in this way is depicted in FIG. 2.

What is claimed is:

1. A process for producing a foamable metal article comprising producing a mixture of at least one metal powder and one gas-producing blowing agent and compacting the mixture to a semifinished product, wherein the gas-producing blowing agent comprises magnesium hydride.

2. The process as claimed in claim 1, wherein the metal powder consists essentially of aluminum, or aluminum alloyed with one or more conventional alloying constituents.

3. The process as claimed in claim 1, wherein the compacting is carried out by cold pressing, cold isostatic pressing, rolling and/or extrusion.

4. The process as claimed in claim 1, wherein the compacting is carried out below the decomposition temperature of the gas-producing blowing agent.

5. The process as claimed in claim 2, wherein the compacting is carried out below the decomposition temperature of the gas-producing blowing agent.

6. The process as claimed in claim 3, wherein the compacting is carried out below the decomposition temperature of the gas-producing blowing agent.

7. The process as claimed in claim 1 wherein the compacting is carried out at room temperature.

8. The process as claimed in claim 2 wherein the compacting is carried out at room temperature.

9. The process as claimed in claim 3 wherein the compacting is carried out at room temperature.

10. The process as claimed in claim 1, wherein the mixture of metal powder and gas-producing blowing agent is compacted to a density of at least 90% of the theoretical density of the metal in the metal powder.

11. The process as claimed in claim 1, wherein the mixture of metal powder and gas-producing blowing agent is compacted to a density of at least 95% of the theoretical density of the metal in the metal powder.

12. The process as claimed in claim 1, wherein the amount of gas-producing blowing agent employed is from 0.1 to 2% by weight based on the metal powder.

13. The process as claimed in claim 1, wherein the amount of gas-producing blowing agent employed is from 0.2 to 1% by weight based on the metal powder.

14. The process as claimed in any one of claims 1 to 13 wherein the gas-producing blowing agent is magnesium hydride or magnesium hydride combined with one or more of titanium hydride, carbonates, hydrates or other readily vaporizing substances.

15. A compacted semifinished product obtained by the process claimed in claim 14.

16. A process for forming a foamed closed-cell metal article, comprising exposing a foamable metal article produced in accordance with any of claims 1 to 13 to elevated or reduced pressure and/or elevated temperature effective to foam said article.

17. A process for foam-filling a cavity in a mold, comprising, producing a foamable metal article in accordance with any of claims 1 to 13, placing said foamable metal article into a cavity in a mold, and then exposing said foamable metal article to elevated or reduced pressure and/or elevated temperature effective to foam said article.

18. A closed-cell foamed metal article obtained by the process of claim 16.

19. A closed-cell foamed metal article obtained by the process of claim 17.

* * * * *